US006785114B2

(12) United States Patent
Gorczyca et al.

(10) Patent No.: US 6,785,114 B2
(45) Date of Patent: Aug. 31, 2004

(54) FORAMINOUS FILTER FOR USE IN AIR IONIZER

(75) Inventors: John Gorczyca, Lansdale, PA (US); Michael Jacobs, Lansdale, PA (US); Nicholas Kowalski, Quakertown, PA (US); Richard D. Rodrigo, Chalfont, PA (US)

(73) Assignee: Illinois Tool Works Inc., Glenview, IL (US)

( * ) Notice: Subject to any disclaimer, the term of this patent is extended or adjusted under 35 U.S.C. 154(b) by 126 days.

(21) Appl. No.: 09/820,593

(22) Filed: Mar. 29, 2001

(65) Prior Publication Data

US 2002/0141131 A1 Oct. 3, 2002

(51) Int. Cl.[7] ..... H01H 23/00

(52) U.S. Cl. ..... 361/231; 361/213; 361/226; 361/229

(58) Field of Search ..... 361/231, 213, 361/226, 229, 233; 96/16, 18, 19

(56) References Cited

U.S. PATENT DOCUMENTS 4,473,382 A 9/1984 Cheslock ..... 96/58
4,496,375 A * 1/1985 Le Vantine ..... 96/66
4,757,422 A 7/1988 Bossard et al. ..... 361/231
4,864,459 A * 9/1989 Larigaldie et al. ..... 361/216
5,055,963 A 10/1991 Partridge
5,973,904 A * 10/1999 Pui et al. ..... 361/225
6,042,637 A 3/2000 Weinberg ..... 96/58
6,118,645 A 9/2000 Partridge
6,375,714 B1 * 4/2002 Rump et al. ..... 95/3

* cited by examiner

*Primary Examiner*—Stephen W. Jackson
(74) *Attorney, Agent, or Firm*—Akin Gump Strauss Hauer & Feld, L.L.P.

(57) ABSTRACT

An improved air ionizer apparatus includes an air inlet, a high voltage source, an electrode electrically connected to the high voltage source for generating ions and an air outlet. An air mover is provided for causing air to flow into the air ionizer through the air inlet and out of the air ionizer through the air outlet. A foraminous filter comprising an electrically conductive material is electrically coupled to at least one of a voltage source and ground. The filter is positioned over at least one of the air inlet, the air outlet and the electrode, such that air flowing into the air inlet, air flowing out of the air outlet or air flowing past the electrode flows through the filter. In a preferred embodiment, the filter comprises a metal grid or screen.

34 Claims, 4 Drawing Sheets

FORAMINOUS FILTER FOR USE IN AIR IONIZER

BACKGROUND OF THE INVENTION

The present invention relates to air ionizers and, more particularly, to an improved air ionizer which provides for enhanced performance.

Air ionizers are generally well known in the art and are employed for a variety of uses, one of which is reducing electrostatic discharge in connection with the manufacture of semiconductors and other products. Air ionizers generate large quantities of both positive and negative ions which are dispensed into the surrounding atmosphere to increase the conductivity of the air within a facility. As ions from the air ionizer flow through the air they are attracted to oppositely charged particles and surfaces causing neutralization of such particles and surfaces. The result is that the positive and negative ions in the ionized air create a static dissipative environment by making the air a carrier of beneficial charges which both dissipate unwanted charges once they occur and significantly limit the magnitude of possible charge generation.

There are several different types of electrically operated air ionizers, although, the fundamental technology employed for generating ions, known as corona discharge is generally the same in all such electrical air ionizers. Electrical ionizers generate air ions by intensifying an electrical field on an electrode having a sharp point until the electrical field overcomes the dielectric strength of the surrounding air. Negative corona occurs when free electrons flow from the electrode into the surrounding air. Positive corona results from the flow of electrons from the air molecules into the electrode. The resulting ion current strength is a function of the applied voltage, the sharpness and conductivity of the electrode, the humidity of the air, atmospheric pressure and other factors.

A typical electrical ionizer comprises a housing having an air inlet, a high voltage source, an electrode with a sharp point connected to the high voltage source for creating the corona discharge which generates the ions, an air outlet and a fan, blower or other air mover for causing air to flow in through the air inlet, past the electrode for picking up the ions and out through the air outlet to the surrounding environment.

While existing electrically operated air ionizers function well for their intended purpose, in some situations, undesirable components, such as noise ions, AC ionization ripple and the like are generated within the air ionizer and are released to the surrounding environment. In addition, in some applications, it is desirable to have the ability to control the output of an electrically operated air ionizer without controlling the high voltage which is applied to the electrode. The present invention comprises an improved air ionizer which provides for both filtering of noise ions, unwanted AC ionization ripple and other unwanted components and better controlling the air ionizer output balance.

BRIEF SUMMARY OF THE INVENTION

Briefly stated, the present invention comprises an improvement in an air ionizer apparatus. The air ionizer apparatus comprises an air inlet, a high voltage source, an electrode electrically connected to the high voltage source for generating ions, an air outlet and an air mover for causing air to flow into the air ionizer through the air inlet, around the electrode and out of the air ionizer through the air outlet.

The improvement comprises a foraminous filter comprising an electrically conductive material. The filter is electrically coupled to at least one of a voltage source and ground and is positioned over at least one of the air inlet, the air outlet and the electrode such that air flowing into the air inlet, air flowing out of the air outlet or air flowing past the electrode flows through the filter. In a preferred embodiment, the filter comprises a metal grid or screen.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
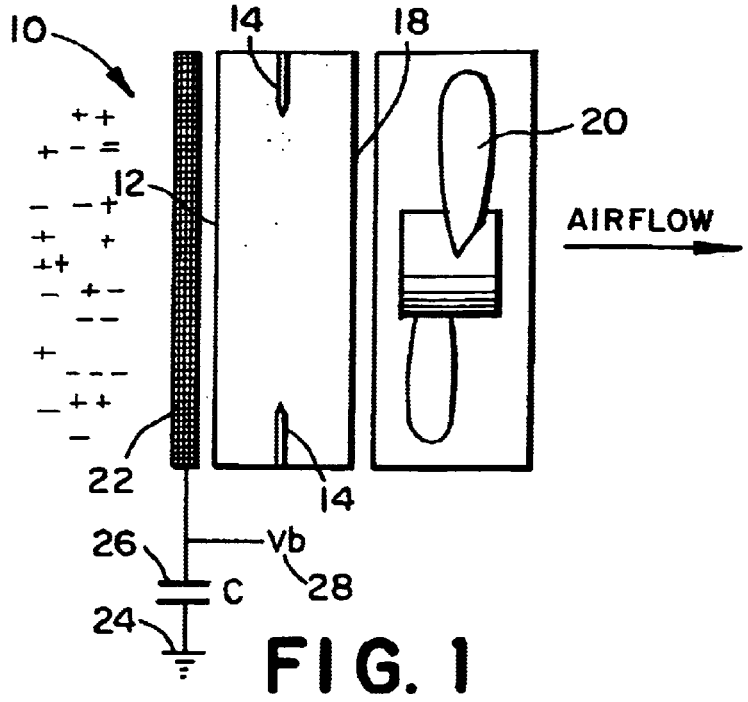
FIG. 1 is a schematic diagram of an electrically operated air ionizer with a filter in accordance with a first embodiment of the present invention.

Referring to the drawings, wherein the same reference numerals are used to indicate the same elements or components throughout the several figures, there is shown in FIG. 1 a first preferred embodiment of an improved air ionizer apparatus 10 in accordance with the present invention. The air ionizer apparatus 10 is shown diagrammatically for the sake of brevity. However, as shown, the air ionizer apparatus 10 includes a housing having an air inlet 12, at least one electrode 14 within the housing which is electrically connected to a high voltage source (not shown on FIG. 1), an air outlet 18 and an air mover 20. In the illustrated embodiment, the air mover 20 is comprised of an electrically driven fan which may be inside or outside of the housing which contains the electrode 14. However, as will be appreciated by those of ordinary skill in the art, any other suitable air mover could alternatively be employed in the air ionizer apparatus 10. As illustrated in FIG. 1, each electrode 14 has a distal end which includes a sharp point to facilitate the creation of corona discharge upon the application of high voltage from the high voltage source (not shown in FIG. 1). The air mover 20 functions to draw air into the housing through the air inlet 12 and into the interior of the air ionizer apparatus 10 proximate to the electrodes 14 to facilitate free electrons from the electrodes 14 being picked up by the moving air and to facilitate the flow of electrons from the moving air into the electrodes 14 to thereby create both positive and negative ions in the air flow. The ionized air then flows out of the air ionizer 10 through the air outlet 18 where the ions are dispersed within the surrounding air.

The air ionizer apparatus 10 as thus far described, is typical of an electrically operated air ionizer of a type well known in the art. The first embodiment of the present invention is an improvement over the prior art air ionizer apparatus as described above comprising a foraminous filter 22 which is positioned over the air inlet 12 such that the air flowing into the air inlet 12 flows through the filter 22. The filter 22 may be physically positioned on the outside of the air ionizer apparatus 10 covering the air inlet 12, may be positioned within a portion of or as part of the air inlet 12 or may be positioned inside of the air ionizer apparatus 10 over the air inlet 12. The particular location of the filter 22 is not critical to the present embodiment as long as all or substantially all of the air flowing into the air ionizer apparatus 10 passes through the filter 22.

The filter 22 is preferably comprised of an electrically conductive material. In the embodiment shown in FIG. 1, the filter is comprised of a metal grid or screen having openings which are sized to achieve the desired effect, preferably in the range of 0.050" to 0.5". Other types of filters 22 comprising an electrically conductive material and other screens or grids of other sizes will be apparent to those of ordinary skill in the art.

In a first preferred embodiment, the filter or screen 22 is electrically coupled to ground 24, preferably the same system ground which is used for the remainder of the air ionizer apparatus 10. The filter or screen 22 may be capacitively coupled to ground utilizing a capacitor 26 or a series of capacitors or some other coupling element or elements. Alternatively, the filter or screen 22 may be resistively coupled to ground utilizing one or more resistors (not shown). In this manner, the filter or screen 22 passively attracts, collects and absorbs both positively charged and negatively charged "noise" ions in the randomly ionized incoming air and prevents such ions from flowing through the air inlet 12 and into the air ionizer 10. The removal of such noise ions significantly reduces or eliminates the influence of such noise ions on the performance of the air ionizer 10.

Alternatively, the filter or screen 22 may be electrically coupled to a voltage source 28. In the embodiment illustrated in FIG. 1, the voltage source 28 is comprised of a bias voltage Vb. of a selected polarity (positive or negative) resulting in the filter or screen 22 being charged for further attraction and absorption of ions in the inlet air flow having the unwanted polarity (opposite of the polarity of the applied voltage). Alternatively, the filter or screen 22 can be programmed with a direct current or control loop voltage for preventing existing direct current offsets in the surrounding environment from entering the air ionizer apparatus 10 through the air inlet 12. By removing unwanted ions from the air entering the air ionizer apparatus 10 and by preventing existing direct current offsets from entering the air ionizer apparatus 10, the performance of the air ionizer apparatus 10 is enhanced.

Figure 2:
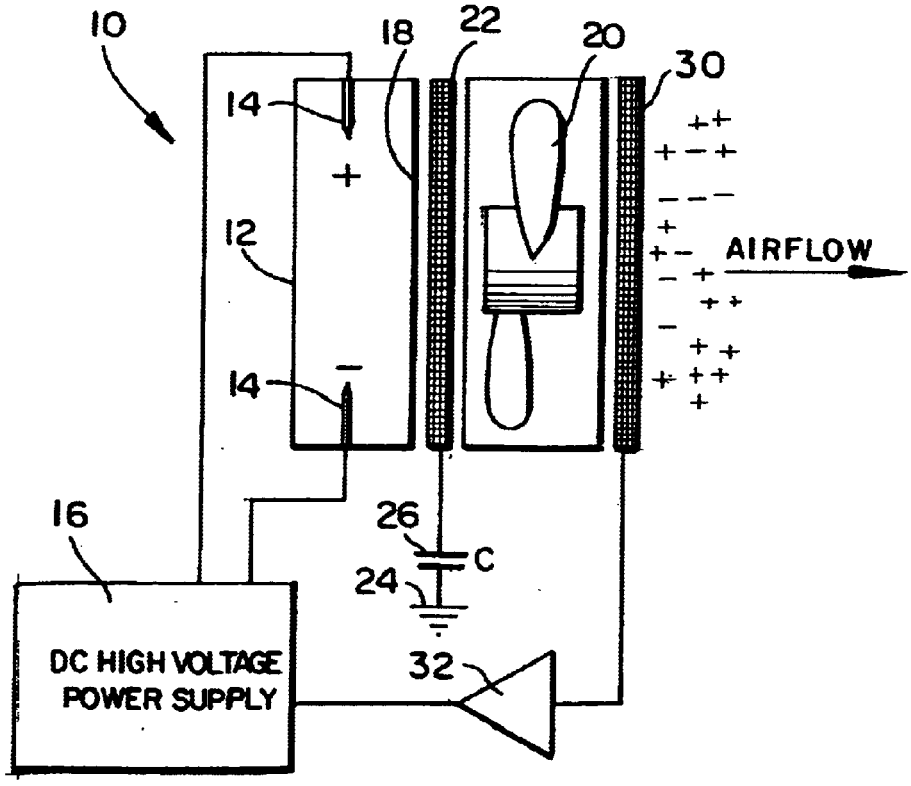
FIG. 2 is a schematic diagram of a DC powered electrically operated air ionizer with a filter in accordance with a second preferred embodiment of the present invention.

FIG. 2 illustrates a second embodiment of an air ionizer apparatus 10 in accordance with the present invention. As with the air ionizer apparatus of FIG. 1, the air ionizer apparatus 10 of FIG. 2 includes a housing having an air inlet 12 at least two electrodes 14, one for each polarity, within the housing which are electrically connected to a high voltage source, in this case a direct current high voltage power supply 16, an air outlet 18 and an air mover 20. As with the embodiment shown in FIG. 1, the air ionizer apparatus 10 of FIG. 2 as thus far described is typical of an electrically operated Bipolar DC powered air ionizer apparatus of a type well know in the art.

The second embodiment, which is also an improvement over the prior art air ionizer apparatus comprises a foraminous filter 22 of the type described above. In the present embodiment, the filter 22 is positioned over the air outlet 18, such that the ionized air flowing out of the air outlet 18 flows through the filter 22. As with the above-described embodiment, the filter 22 of the second embodiment may be physically positioned on the outside of the air ionizer apparatus 10 covering the air outlet 18, may be positioned within a portion or as a part of the air outlet 18 or may be positioned inside of the air ionizer apparatus 10 over the air outlet 18. The particular location of the filter 22 is not critical to the present embodiment as long as all or substantially all of the air flowing out of the air ionizer apparatus 10 which flows through the air outlet 18 also passes through the filter 22. As with the above-described embodiment, the filter 22 is preferably comprised of an electrically conductive material and, more preferably is comprised of a metal grid or screen having openings which are sized to achieve the desired effect, preferably in the range of 0.050" to 0.5". Other types of filters 22 comprising an electrically conducted material and other grids or screens of other sizes will be apparent to those of ordinary skill in the art. As with the above-described embodiment, the screen 22 of the second embodiment may be electrically coupled to ground 24 utilizing a capacitor 26, a series of resistors, capacitors or some other coupling element or elements.

In the embodiment illustrated in FIG. 2, the air ionizer apparatus 10 includes a second filter or screen 30 which functions as a sensor for sensing the flow of ions or ion content of the air flowing out of the air ionizer apparatus 10. The second filter or screen 30 is coupled through an active feedback network including operational amplifiers 32 (only are shown for clarity) to provide feedback for directly controlling the output voltage of the direct current, high voltage power supply 16. In this manner, the first filter or screen 22 provides a path for the removal of noise ions in the ionized air flowing out of the air ionizer apparatus 10 through the air outlet 18. The filter or screen 22 also reduces unwanted AC output (ripple) within the ionized air flowing through air outlet 18 and improves the overall direct current (DC) balance within the air to provide a more homogenous ion cloud. The feedback from the second filter or screen 30 to the direct current high voltage power supply 16 is employed to control the DC balance of the air flowing out of the air ionizer apparatus to thereby enhance performance.

Figure 3:
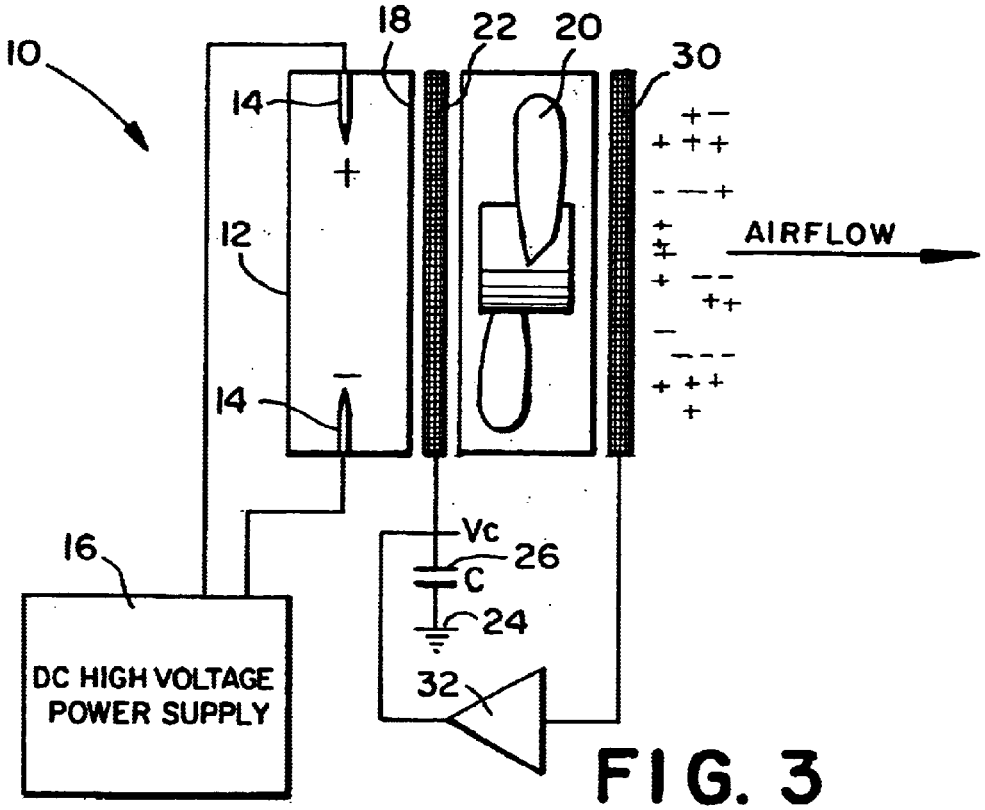
FIG. 3 is a schematic diagram DC powered electrically operated air ionizer with a filter in accordance with a third preferred embodiment of the present invention.

A third preferred embodiment of an improved air ionizer apparatus 10 is illustrated in FIG. 3. The air ionizer apparatus 10 of FIG. 3 is structurally substantially the same as the air ionizer apparatus as shown in FIG. 2. However, in the air ionizer apparatus 10 of FIG. 3, the feedback voltage from the active feedback network comprising operational amplifiers 32 is applied as a control voltage Vc to the first filter or screen 22. In the embodiment of FIG. 3, the filter or screen 22 provides a path for the removal of noise ions and controls ion balance in the air flowing out of the air ionizer apparatus 10. The filter or screen 22 also reduces unwanted AC output (ripple) from the air flowing out of the air ionizer apparatus 10 and improves the DC balance to provide a more homogenous ion cloud. In the embodiment of FIG. 3, the DC balance is further controlled by programming the voltage of the filter or screen 22 based upon the feedback voltage obtained at the sensor filter or screen 30 from the output of the air ionizer apparatus 10.

Figure 4:
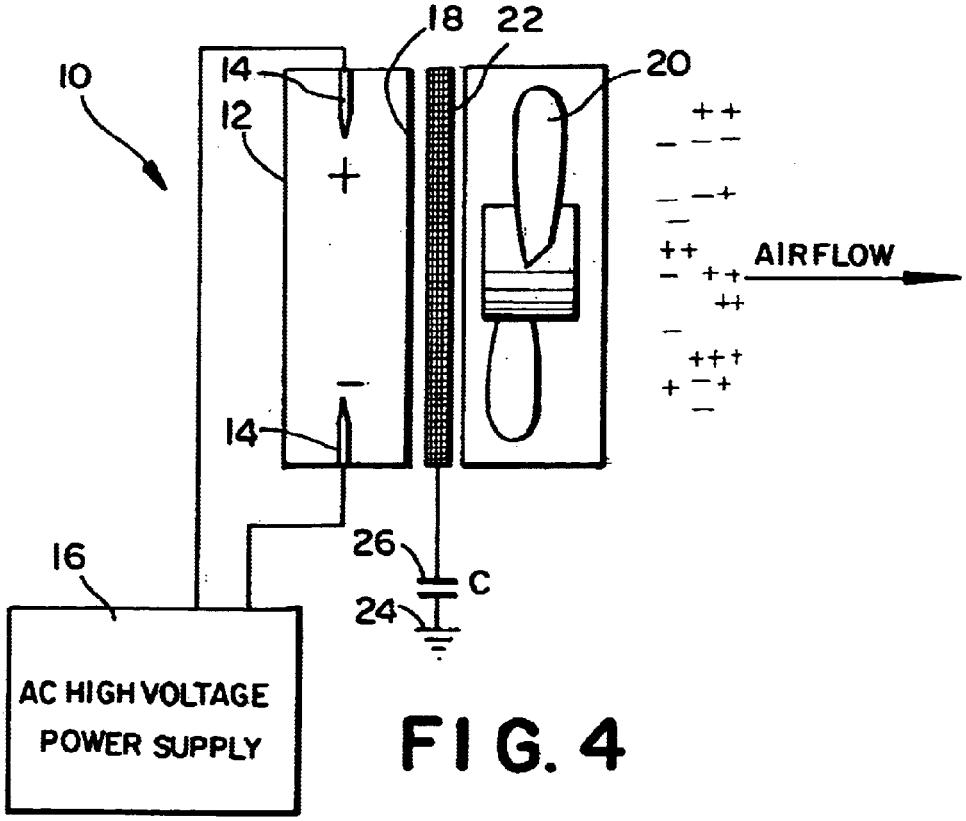
FIG. 4 is a schematic diagram of an AC powered electrically operated air ionizer with a filter in accordance with a fourth preferred embodiment of the present invention.

A fourth embodiment of an improved air ionizer apparatus 10 is shown in FIG. 4. The air ionizer apparatus 10 of FIG. 4 includes a housing having an air inlet 12, at least one electrode 14 within the housing which is electrically connected to a high voltage source, in this embodiment an AC high voltage power supply 16, an air outlet 18 and an air mover 20. A foraminous filter or screen 22 is positioned over the air outlet 18 as described above in connection with the embodiment shown in FIG. 2. The filter or screen 22 is preferably comprised of an electrically conductive material and is electrically coupled to ground 24 utilizing a capacitor 26, a series of resistors, capacitors or some other coupling element or elements (not shown). In this manner, the filter or screen 22 provides a path for eliminating unwanted ions in the air flowing out of the air ionizer apparatus 10, effectively damping the AC component of the air ionizer apparatus to provide a more homogenous output. The reduction of unwanted ions improves balance stability within the air ionizer apparatus 10.

Figure 5:
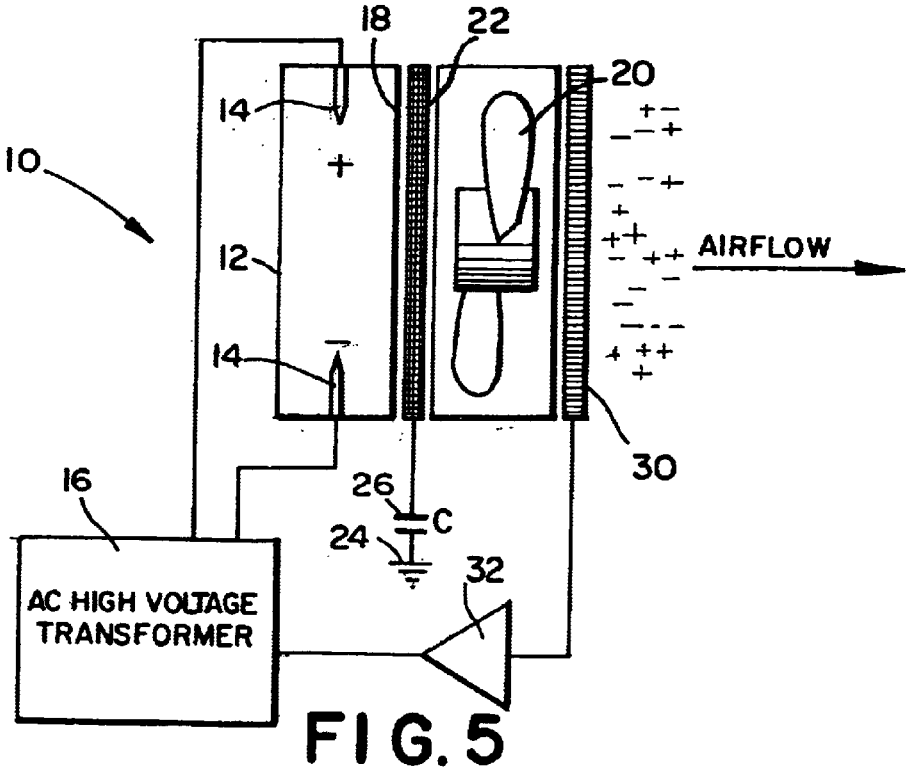
FIG. 5 is a schematic diagram of an AC powered electrically operated air ionizer with a filter in accordance with a fifth preferred embodiment of the present invention.

FIG. 5 illustrates a fifth embodiment of the present invention. The air ionizer apparatus 10 as shown in FIG. 5 is substantially the same as the air ionizer apparatus of FIG. 4. However, as in the embodiments of FIGS. 2 and 3, the air ionizer apparatus 10 of FIG. 5 further includes a second filter or screen 30 which functions as a sensor for sensing ions or ion content in the air flow out of the air ionizer apparatus 10. The second screen 30 is connected through an active feedback network comprising operational amplifiers 32 to provide a direct feedback voltage to control the output voltage of the AC high voltage power supply 16.

As with the embodiment shown in FIG. 4, the filter or screen 22 provides a path for the removal of unwanted AC ions at the output of the air ionizer apparatus 10 to improve balance stability within the output air flow. Balance is further achieved by employing the feedback from the sensor screen 30 to control the voltage output from the AC high voltage power supply 16. In the present embodiment, the feedback signal is provided to the center tap of a high voltage secondary of an AC transformer. However, other techniques could be employed for feedback control of the high voltage AC power supply 16.

Figure 6:
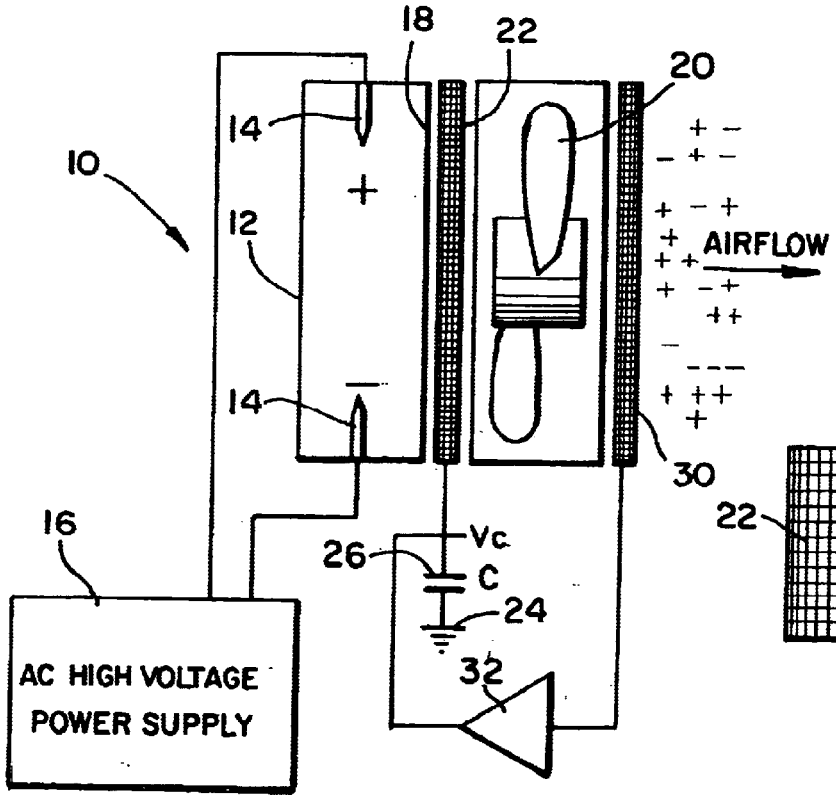
FIG. 6 is a schematic diagram of an AC powered electrically operated air ionizer with a filter in accordance with a sixth preferred embodiment of the present invention.

A sixth preferred embodiment of the present invention is illustrated in FIG. 6. The air ionizer apparatus 10 of FIG. 6 is substantially the same as the air ionizer apparatus of FIG. 5. However, in the air ionizer apparatus 10 of FIG. 6, the feedback signal from the second filter or screen 30 is amplified by the active feedback network of operational amplifiers 32 and is applied as a feedback voltage Vc to the first filter or screen 22. As with the above-described embodiments, the filter or screen 22 provides a path for removing unwanted AC ions at the output of the air ionizer apparatus, thereby, improving balance stability within the output air. The output balance is further enhanced by programming the voltage on the filter or screen 22 utilizing the feedback voltage from the second, sensor filter or screen 30.

Figure 7:
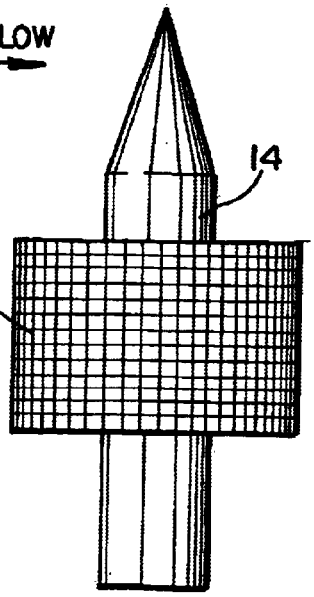
FIG. 7 is a schematic diagram of an electrode of an electrically operated air ionizer surrounded by a filter in accordance with a seventh preferred embodiment of the present invention.

FIG. 7 illustrates a further embodiment of the present invention. As shown in FIG. 7, an electrode 14 of air ionizer apparatus is at least partially surrounded by a filter or screen 22. The screen 22 of the embodiment shown in FIG. 7 may be coupled to ground, may be coupled to a bias voltage or may be coupled to a feedback voltage or some combination thereof as described above. The filter or screen 22 of the embodiment shown in FIG. 7 functions in substantially the same manner as in the above-described embodiments to reduce unwanted ions, reduce unwanted AC output ripple and improve DC balance in the air flowing out of the air ionizer apparatus.

Figure 8:
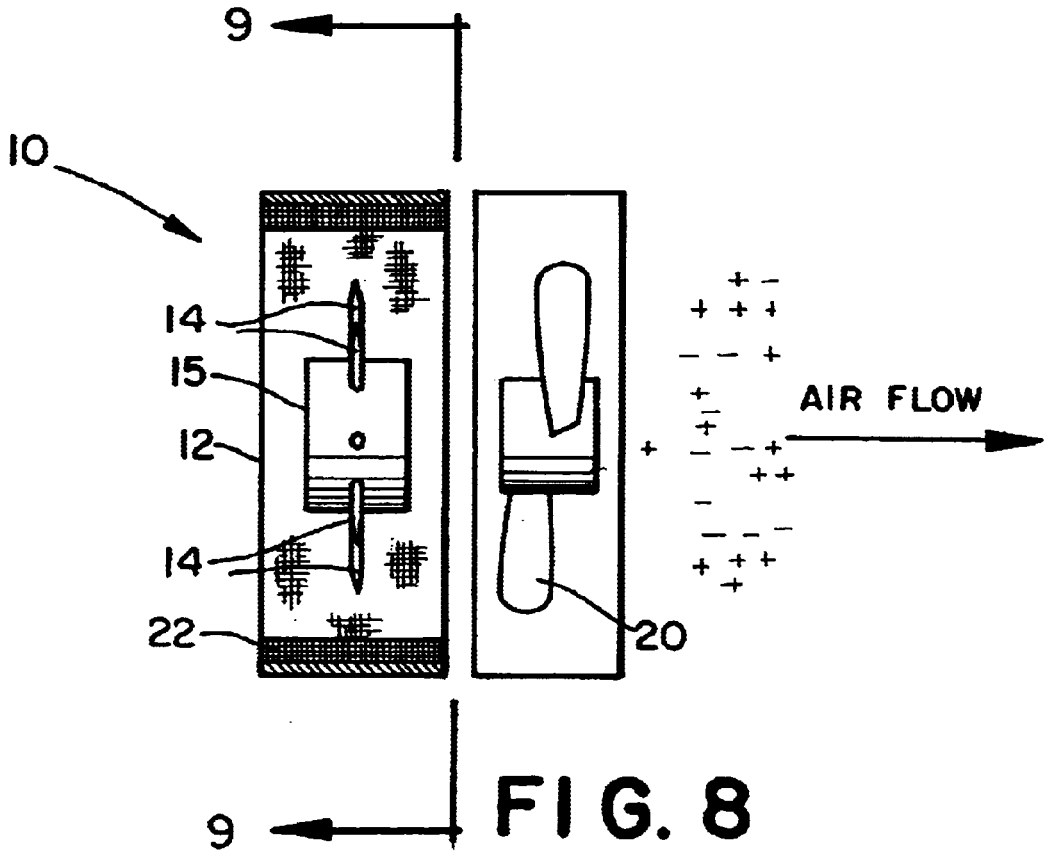
FIGS. 8–9 are schematic diagrams of an electrically operated air ionizer with a filter in accordance with alternate embodiments of the preferred embodiments having electrodes that extend radially outwardly at spaced locations around a central hub.
Figure 9:
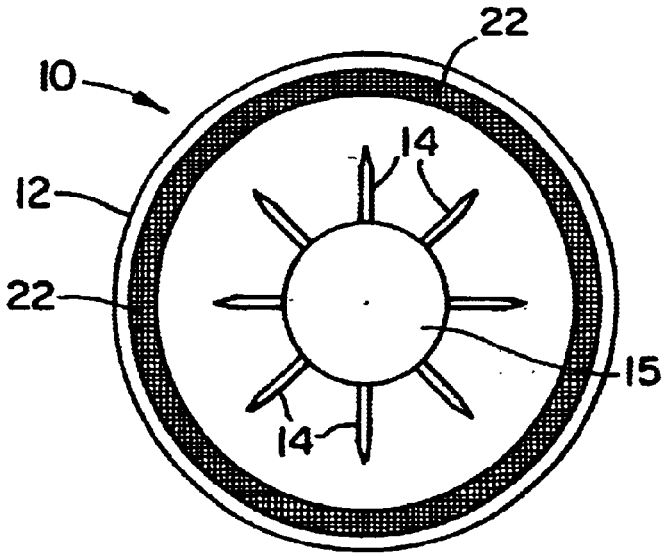

A seventh preferred embodiment of the present invention is illustrated in FIGS. 8 and 9. The air ionizer apparatus 10 of FIGS. 8 and 9 is substantially the same as described above in connection with the other embodiments. However, in the air ionizer apparatus 10 of FIGS. 8 and 9, the electrodes 14 extend radially outwardly at spaced locations around a central hub 15 as opposed to extending radially inwardly as with the previously described embodiments. Further, the filter or screen 22 is located around the interior surface of the housing of the air ionizer apparatus. Depending upon the type of air ionizer apparatus 10, the filter or screen 22 may be connected to ground, to a DC high voltage power supply, to an AC high voltage power supply or the like in the manner as discussed in connection with the above-described embodiments. The seventh embodiment also includes a suitable air mover 20 of the type described above for moving air into the ionizer apparatus 10 through the air inlet 12 so that the air passes by the electrodes 14 in the manner described above. As with the above-described embodiments, the filter or screen 22 provides a path for removing unwanted ions from the output of the air ionizer apparatus 10 to improve stability and otherwise enhance performance.

From the foregoing it can be seen that the present invention, as illustrated in the seven above-described embodiments, comprises a filter or screen formed of an electrically conducted material which is strategically placed over the inlet of the air ionizer apparatus, over the outlet of the air ionizer apparatus or both or, alternatively, around an electrode of an air ionizer apparatus for the purpose of enhancing the performance of the air ionizer apparatus. Performance is enhanced by utilizing the filter to filter out unwanted ionization, remove unwanted AC components (ripple) and to maintain or restore the DC output balance within the air flowing out of the air ionizer apparatus. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. In a bipolar air ionizer apparatus comprising an air inlet, a high voltage source, a first electrode electrically connected to the high voltage source and configured to generate positive polarity ions, a second electrode electrically connected to the high voltage source and configured to generate negative polarity ions, an air outlet and an air mover for causing air to flow into the bipolar air ionizer through the air inlet, around the electrodes and out of the bipolar air ionizer through the air outlet, wherein the improvement comprises:

a foraminous filter comprising an electrically conductive material, the filter being electrically coupled to at least one of a voltage source and ground, the filter being positioned over at least one of the air inlet, the air outlet and the electrodes, such that air flowing into the air inlet, air flowing out of the air outlet or air flowing past the electrodes flows through the filter.

2. The bipolar air ionizer as recited in claim 1, wherein the filter is positioned over the air inlet and is electrically coupled to ground for removing positive and negative ions from the air flowing into the bipolar air ionizer.

3. The bipolar air ionizer as recited in claim 2, wherein the filter comprises a metal screen.

4. The bipolar air ionizer as recited in claim 1, wherein the filter is positioned over the air inlet and is electrically coupled to a voltage source for preventing existing voltage offsets in the air of the surrounding environment from flowing into the bipolar air ionizer.

5. The bipolar air ionizer as recited in claim 4, wherein the voltage source which is electrically coupled to the filter comprises one of a direct current voltage and a control loop voltage.

6. The bipolar air ionizer as recited in claim 4, wherein the filter is comprised of a metal screen.

7. The bipolar air ionizer as recited in claim 1, wherein the filter is positioned over the air outlet and is electrically coupled to ground for removing unwanted positive and negative ions and ionization noise from ionized air flowing out of the bipolar air ionizer through the air outlet.

8. The bipolar air ionizer as recited in claim 7, wherein the filter comprises a metal screen.

9. The bipolar air ionizer apparatus as recited in claim 1, wherein the high voltage source comprises a high voltage direct current power supply and wherein the filter is positioned over the air outlet and is coupled to a direct current voltage source for reducing noise ions from the ionized air flowing out of the bipolar air ionizer through the air outlet and for controlling the direct current balance of the ionized air flowing out of the bipolar air ionizer.

10. The bipolar air ionizer as recited in claim 9, wherein the filter comprises a metal screen.

11. The bipolar air ionizer as recited in claim 9, further comprising a sensor at the air outlet for sensing ion content of the outlet air, the sensor providing a feedback voltage for controlling the output of the high voltage direct current power supply.

12. The bipolar air ionizer as recited in claim 9, further comprising a sensor at the air outlet for sensing ion content of the outlet air, the sensor providing a feedback voltage for controlling the direct current voltage source coupled to the filter.

13. A method of removing ions from air flowing into a bipolar air ionizer having an air inlet, a high voltage source, a first electrode electrically connected to the high voltage source and configured to generate positive polarity ions, a second electrode electrically connected to the high voltage source and configured to generate negative polarity ions, an air outlet and an air mover for causing air to flow into the bipolar air ionizer through the air inlet, around the electrodes and out of the bipolar air ionizer through the air outlet, the method comprising the steps of:

placing a foraminous filter comprising an electrically conductive material over the air inlet; and coupling the filter to one of a voltage source and ground.

14. The method as recited in claim 13, wherein the filter comprises a metal screen.

15. A method for removing unwanted ions and ionization noise from ionized air flowing out of a bipolar air ionizer, the bipolar air ionizer having an air inlet, a high voltage source, a first electrode electrically connected to the high voltage source and configured to generate positive polarity ions, a second electrode electrically connected to the high voltage source and configured to generate negative polarity ions, an air outlet and an air mover for causing air to flow into the bipolar air ionizer through the air inlet, around the electrodes and out of the bipolar air ionizer through the air outlet, the method comprising the steps of:

placing a foraminous filter comprising an electrically conductive material over the air outlet; and coupling the filter to one of a voltage source and ground.

16. The method as recited in claim 15 wherein the filter comprises a metal screen.

17. A method of removing ions from air flowing into a bipolar air ionizer having an air inlet, a high voltage source, a first electrode electrically connected to the high voltage source and configured to generate positive polarity ions, a second electrode electrically connected to the high voltage source and configured to generate negative polarity ions, an air outlet and an air mover for causing air to flow into the bipolar air ionizer through the air inlet, around the electrodes and out of the bipolar air ionizer through the air outlet, the method comprising the steps of:

placing a foraminous filter comprising an electrically conductive material around the electrodes; and coupling the filter to one of a voltage source and ground.

18. The method as recited in claim 17, wherein the filter comprises a metal screen.

19. In a bipolar air ionizer apparatus comprising an air inlet, a high voltage source, a first electrode electrically connected to the high voltage source and configured to generate positive polarity ions, a second electrode electrically connected to the high voltage source and configured to generate negative polarity ions, an air outlet and an air mover for causing air to flow into the bipolar air ionizer through the air inlet, around the electrodes and out of the bipolar air ionizer through the air outlet, wherein the improvement comprises:

a foraminous filter comprising an electrically conductive material, the filter being electrically coupled to one of a voltage source and ground, the filter being positioned on an interior surface of the bipolar air ionizer apparatus, such that at least a portion of the air flowing past the electrodes engages the filter.

20. The bipolar air ionizer apparatus as recited in claim 19, wherein the filter comprises a metal screen.

21. A method of removing unwanted ions from air flowing out of a bipolar air ionizer, the bipolar air ionizer having an air inlet, a high voltage source, a first electrode electrically connected to the high voltage source and configured to generate positive polarity ions, a second electrode electrically connected to the high voltage source and configured to generate negative polarity ions, an air outlet and an air mover for causing air to flow into the bipolar air ionizer through the air inlet, around the electrodes and out of the bipolar air ionizer through the air outlet, the method comprising the steps of:

placing a foraminous filter comprising an electrically conductive material over an interior surface of the bipolar air ionizer apparatus proximate to the electrodes; and coupling the filter to one of a voltage source and ground.

22. The method as recited in claim 21 wherein the filter comprises a metal screen.

23. In a bipolar air ionizer apparatus comprising an air inlet, a high voltage source having a high voltage alternating current power supply, an electrode electrically connected to the high voltage alternating current power supply and configured to alternately generate positive polarity ions and negative polarity ions, an air outlet and an air mover for causing air to flow into the bipolar air ionizer through the air inlet, around the electrode and out of the bipolar air ionizer through the air outlet, wherein the improvement comprises:

a foraminous filter comprising an electrically conductive material, the filter being coupled to ground through at least one of a resistor and a capacitor, the filter being positioned over at least one of the air inlet, the air outlet and the electrode, such that air flowing into the air inlet, air flowing out of the air outlet of air flowing past the electrode flows through the filter.

24. The bipolar air ionizer as recited in claim 23, wherein the filter is positioned over the air outlet and is coupled to a direct current voltage source for reducing noise ions from the ionized air flowing out of the bipolar air ionizer and for controlling the direct current balance of the ionized air flowing out of the bipolar air ionizer.

25. The bipolar air ionizer as recited in claim 24, wherein the filter comprises a metal screen.

26. The bipolar air ionizer apparatus of claim 23, wherein the filter has a bias voltage applied thereto.

27. A method of removing ions from air flowing into a bipolar air ionizer having an air inlet, a high voltage source having a high voltage alternating current power supply, an electrode electrically connected to the high voltage alternating current power supply and configured to alternately generate positive polarity ions and negative polarity ions, an air outlet and an air mover for causing air to flow into the bipolar air ionizer through the air inlet, around the electrode and out of the bipolar air ionizer through the air outlet, the method comprising:

placing a foraminous filter comprising an electrically conductive material over the air inlet; and coupling the filter to ground through at least one of a resistor and a capacitor.

28. The method of claim 27, further comprising:

applying a bias voltage to the filter.

29. A method of removing ions from air flowing into a bipolar air ionizer having an air inlet, a high voltage source having a high voltage alternating current power supply, an electrode electrically connected to the high voltage alternating current power supply and configured to alternately generate positive polarity ions and negative polarity ions, an air outlet and an air mover for causing air to flow into the bipolar air ionizer through the air inlet, around the electrode and out of the bipolar air ionizer through the air outlet, the method comprising:

placing a foraminous filter comprising an electrically conductive material around the electrode; and coupling the filter to ground through at least one of a resistor and a capacitor.

30. The method of claim 29, further comprising:

applying a bias voltage to the filter.

31. In a bipolar air ionizer apparatus comprising an air inlet, a high voltage source having a high voltage alternating current power supply, an electrode electrically connected to the high voltage alternating current power supply and configured to alternately generate positive polarity ions and negative polarity ions, an air outlet and an air mover for causing air to flow into the bipolar air ionizer through the air inlet, around the electrode and out of the bipolar air ionizer through the air outlet, wherein the improvement comprises:

a foraminous filter comprising an electrically conductive material, the filter being coupled to ground through at least one of a resistor and a capacitor, the filter being positioned on an interior surface of the bipolar air ionizer apparatus, such that at least a portion of the air flowing past the electrodes engages the filter.

32. The bipolar air ionizer apparatus of claim 31, wherein the filter has a bias voltage applied thereto.

33. A method of removing unwanted ions from air flowing out of a bipolar air ionizer, the bipolar air ionizer having an air inlet, a high voltage source having a high voltage alternating current power supply, an electrode electrically connected to the high voltage alternating current power supply and configured to alternately generate positive polarity ions and negative polarity ions, an air outlet and an air mover for causing air to flow into the bipolar air ionizer through the air inlet, around the electrode and out of the bipolar air ionizer through the air outlet, the method comprising:

placing a foraminous filter comprising an electrically conductive material over an interior surface of the bipolar air ionizer apparatus proximate to the electrode; and coupling the filter to ground through at least one of a resistor and a capacitor.

34. The method of claim 33, further comprising:

applying a bias voltage to the filter.

* * * * *